United States Patent [19]

Abe et al.

[11] Patent Number: 4,568,214

[45] Date of Patent: Feb. 4, 1986

[54] MAKE-UP BRUSH

[75] Inventors: Katsunori Abe, Kawaguchi; Toshio Inoue, Tokyo, both of Japan

[73] Assignees: Osawa Chemical Industries, Ltd.; Tombow Pencil Co., Ltd., both of Tokyo, Japan

[21] Appl. No.: 564,640

[22] Filed: Dec. 22, 1983

[30] Foreign Application Priority Data

Mar. 11, 1983 [JP] Japan ..... 58-35937[U]

[51] Int. Cl.[4] ..... A45D 34/00

[52] U.S. Cl. ..... 401/141; 401/142; 401/196; 401/199; 401/207

[58] Field of Search ..... 401/141, 142, 199, 283, 401/196, 198, 207

[56] References Cited

U.S. PATENT DOCUMENTS

| | | | |
|---|---|---|---|
| 2,948,008 | 8/1960 | Leeds et al. | 401/283 X |
| 3,181,539 | 5/1965 | Aston | 401/198 X |

FOREIGN PATENT DOCUMENTS

| | | | |
|---|---|---|---|
| 841277 | 4/1952 | Fed. Rep. of Germany | 401/196 |
| 1297512 | 6/1969 | Fed. Rep. of Germany | 401/142 |
| 2555391 | 11/1976 | Fed. Rep. of Germany | 401/196 |
| 1097511 | 2/1955 | France | 401/142 |
| 695673 | 8/1953 | United Kingdom | 401/142 |

*Primary Examiner*—Steven A. Bratlie

*Attorney, Agent, or Firm*—David A. Jackson; Daniel H. Bobis

[57] ABSTRACT

A make-up brush comprises a tapered hollow body made of a porous material restorable in shape when deformed, having a surface for oozing a make-up liquid, a make-up liquid guiding core covered by the hollow body and tightly inserted through a head seat fixed to one end of a liquid cylinder, a head cylinder through which the tapered hollow body extends, the head cylinder being secured to one end of a shaft cylinder to fix the tapered hollow body thereat, and a viscous substance filled in the liquid cylinder after the make-up liquid is filled in the liquid cylinder on a side of the head seat, thereby causing the make-up liquid to smoothly flow out of the make-up brush.

4 Claims, 1 Drawing Figure

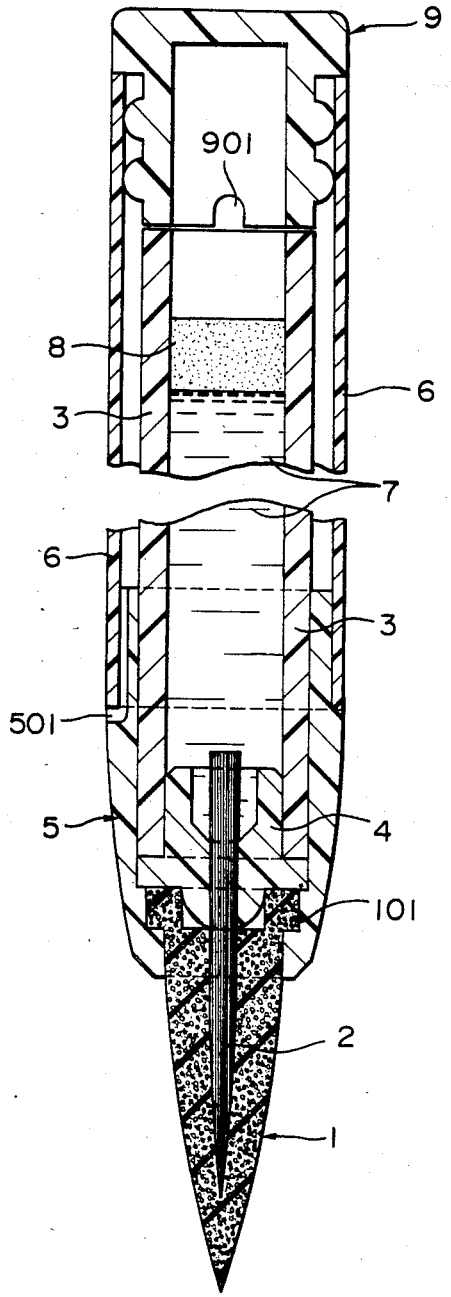
9
901
8
6
3
7
6
3
501
5
4
101
2
1

MAKE-UP BRUSH

BACKGROUND OF THE INVENTION

1. Field of the Invention

This invention relates to an improvement of a make-up brush containing therein a make-up liquid, and more particularly to a make-up brush containing therein a flowable low viscous make-up liquid to be used for eye line, rouge, eyebrow make-up and the like.

2. Description of the Prior Art

Coloring soft solid pieces or coloring soft pieces like lead of a pencil have been know for make-up for eyelids, eyebrows, lips and the like. Although these pieces are soft, it is necessary for these known pieces to be applied to a user's face with comparatively high pressure because the pieces are solid. Particularly, there is a risk of injuring mucoidal skin near the user's eyes during make-up.

A liquid containing article for make-up liquid for eye lines, eyebrows and the like having a painting portion made of a soft material in the form of a traditional fountain pen has been known. This article eliminates the above disadvantage of the solid pieces to some extent. However, because of the low viscous make-up liquid, when such a fountain pen type make-up article is carried or stored upside down, the make-up liquid flows down toward a rear end of the article remote from the painting portion, making it difficult to immediately use.

On the other hand, when this article is carried with its painting portion facing downward, air flows into a make-up liquid tank as the remaining make-up liquid decreases. There is therefore a risk of leakage of the liquid owing to expansion in volume of the air due to variation in temperature.

SUMMARY OF THE INVENTION

As the result of the inventor's experiments in consideration of the above facts, it has been found that even if air flows into a liquid cylinder as a low viscous make-up liquid is consumed, the liquid flows smoothly out of the liquid cylinder so long as the article for make-up is constructed so as to prevent excess liquid flow. The invention resides in such a discovery.

It is an object of the invention to provide an improved effective make-up brush comprising a liquid cylinder filled on a head seat side successively with a low viscous make-up liquid and a viscous substance for preventing a reverse flowing of the liquid, so that even if air flows into the liquid cylinder on a side opposite to the head seat side, the viscous substance prevents the promoting action for excess liquid flowing with the aid of a contact resistance between the viscous substance and the liquid cylinder wall and further prevents the air from flowing into the make-up liquid, and the make-up liquid and the viscous substance smoothly move together to cause the make-up liquid to smoothly flow out of the brush.

In order that the invention may be more clearly understood, preferred embodiments will be described, by way of example, with reference to the accompanying drawings.

BRIEF DESCRIPTION OF THE DRAWING

The single drawing is a longitudinal sectional view of a preferred embodiment of a make-up brush according to the invention.

DETAILED DESCRIPTION OF THE PREFERRED EMBODIMENT

Referring to the drawing illustrating a preferred embodiment of the invention, a make-up brush comprises a tapered hollow body 1 made of a porous elastomeric material such as rubber restoreable when deformed and having a great number of voids communicating with each other and with the inside and outside thereof. If the hollow body 1 were not porous and an elastomeric material, it could not ooze or exude a make-up liquid from all over its surface and could not restore or regain its original shape when curved. The material for the tapered hollow body 1 is most preferably a porous synthetic resin (for example, an acrylic resin), but it may be a known fibrous hollow brush, as the case may be. The tapered hollow body 1 covers and is in contact with all or part of a make-up liquid guiding core 2 including its front tip as shown in the drawing.

The "front" used herein means the liquid oozing side of the brush corresponding to the lower end shown in the drawing and "rear" used herein means the side of the brush to be gripped by the hand of a user corresponding to the upper end shown in the drawing.

The rear part of the tapered hollow body 1 made of the porous synthetic resin enclosing a front half of the guiding core 2 including its front tip is thicker in wall thickness than the remaining part of the tapered hollow body 1 as shown in the drawing. However, the tapered hollow body 1 may be uniform in its wall thickness (not shown).

The guiding core 2 is made of synthetic fibers longitudinally extending substantially in parallel with each other hardened together by a liquid synthetic resin to an extent without affecting their flexibility and having fine communicating clearances therein. The guiding core 2 may be made of fibrous material such as felt, unwoven fabric or the like, and sintered granular synthetic resin to form a tapered rod. At any rate, the guide core 2 should be constructed so as to cause the capillary action for feeding the make-up liquid 7 in addition to holding the liquid.

The liquid cylinder 3 is made of either a transparent or an opaque material. The liquid cylinder 3 is provided on its one end with a head seat 4 fixed thereto and has the other end which is opened to permit air to flow from the open end into its interior.

A head cylinder 5 is formed with vent means 501 for causing air to flow into and out of the head cylinder 5 freely when it is fixed to a shaft cylinder 6. The vent means 501 is shown as an L-shaped passage in the drawing.

The guiding core 2 is fitted in the tapered hollow body 1 which in turn tightly extends through the head cylinder 5 so that an outwardly extending flange 101 of the tapered hollow body at its rear end is embraced between the head seat 4 and head cylinder 5 to fix the tapered hollow body 1 in position, while a part of the guiding core 2 in the proximity of its rear end is tightly fitted in the head seat 4 so as to be fixed thereat in a manner allowing the make-up liquid in the liquid cylinder 3 to flow through guiding core 2 with the aid of the capillary action.

The shaft cylinder 6 is provided at its one end opposite to the head cylinder 5 with a tail plug 9 fitted therein having vent means 901 for allowing the air flowing in the shaft cylinder 6 to flow into a bottom or rear end of the liquid cylinder 3 so as to freely exchange air between the interior and the exterior of the shaft cylinder. The vent means 901 of the tail plug 9 is shown in the drawing for example in the form of a notch. A make-up liquid is a comparatively flowable or low viscous liquid less than 50 cm poise and is filled in the liquid cylinder 3 on the head seat side. A viscous substance 8 is filled in the liquid cylinder 3 on the rear side for preventing the make-up liquid from flowing out of the cylinder 3, even if it is turned upside down and for preventing air from flowing into the make-up liquid. The viscous substance 8 may be a known grease or a material having a viscosity as high as that of the grease, with the amount to be filled being preferably as little as possible. The viscous substance 8 serves to prevent the make-up liquid 7 from reversely flowing and prevent air from flowing into the make-up liquid 7. The viscous substance 8 may be laminated by more than two materials.

The air must not remain in the make-up liquid 7 after the viscous substance 8 has been filled in the liquid cylinder 3. Accordingly, after the make-up liquid and the viscous substance are filled in succession in the liquid cylinder 3, this assembly is treated by a centrifugal separator to remove the air contained in the liquid. In order to prevent the make-up liquid 7 from scattering during such a treatment, a closing plate (not shown) abuts against a reduced diameter tip of the head seat 4 fixed to the liquid cylinder 3 and extending therefrom so as to be able to close a center aperture of the head seat 4 before the treatment.

The suction force of the guiding core 2 for the make-up liquid and the make-up liquid flowing-out preventing force of the viscous substance are maintained in a substantially equilibrium condition in a manner that the former is slightly greater than the latter, such that when the make-up liquid 7 is successively moved by the suction force of the guiding core 2, the viscous substance 8 is moved together therewith. As the make-up liquid 7 decreases in this manner, the viscous substance 8 approaches the guiding core 2.

With the arrangement above described according to the invention, the make-up brush can be used with a flexible touch with the aid of the restoring faculty of the tapered hollow body which regains its original shape immediately after releasing the pressure without forcing it into the original shape every time when the brush is used, thereby enabling the brush to be used repeatedly. Moreover, the make-up brush according to the invention comprises the viscous substance which prevents respectively the low viscous make-up liquid from flowing in reverse directions, air from entering the make-up liquid to form air bubbles therein, the air flowing in the liquid cylinder from causing the make-up liquid to flow out to an excess extent and other problems, and further prevents the make-up liquid from intermittently flowing out of the brush which would otherwise occur with the above problems. In use, therefore, the viscous substance is moved smoothly together with the make-up liquid to cause it to flow out little by little with a suitable amount and whenever the brush is used, the liquid flows out smoothly so long as the liquid remains in the brush. Furthermore, if an ink or india ink is charged into the make-up brush, it can be also used for writing.

It is further understood by those skilled in the art that the foregoing description is that of preferred embodiments of the disclosed make-up brush and that various changes and modifications may be made in the invention without departing from the spirit and scope thereof.

What is claimed is:

1. A make-up brush comprising:

liquid cylinder means for containing a non-viscous liquid;

head seat means secured to one end of said liquid cylinder means;

make-up liquid guiding core means tightly inserted through said head seat means;

tapered hollow body means made of a resilient, porous material having communicating voids and having an exposed outer surface, the entire exposed outer surface forming a make-up liquid oozing face, said tapered hollow body means surrounding said liquid guiding core means;

surrounding cylinder means surrounding said liquid cylinder means in a fluid tight arrangement at said one end thereof and defining an air passageway therebetween for providing fluid communication between the opposite end of said liquid cylinder means and ambient air, said surrounding cylinder means and said head seat means cooperating to secure said tapered hollow body means therebetween; and viscous substance means within said liquid cylinder means and cooperating with said head seat means for maintaining said non-viscous liquid therebetween and for preventing reverse flow of said non-viscous liquid.

2. A make-up brush according to claim 1; wherein said surrounding cylinder means includes head cylinder means partially surrounding said liquid cylinder means and extending past said one end thereof, said head cylinder means includes an inwardly directed flange, and said head seat means includes a first portion which tightly fits within said one end of said liquid cylinder means and a second flange portion which abuts against the free end of said one end of said liquid cylinder means, and said tapered hollow body means includes flange means sandwiched between said second flange portion of said head seat means and said inwardly directed flange of said head cylinder means.

3. A make-up brush according to claim 1; wherein said surrounding cylinder means includes head cylinder means partially surrounding said liquid cylinder means and having a first end that extends past said one end of said liquid cylinder means, and shaft cylinder means surrounding said liquid cylinder means and having a first end secured to a second, opposite end of said head cylinder means, and further comprising vent opening means defined by at least one of said head cylinder means and said shaft cylinder means for providing fluid communication between said air passageway and ambient atmosphere.

4. A make-up brush according to claim 3; wherein said vent opening means is defined between said head cylinder means and said shaft cylinder means.

* * * * *